US008783055B2

(12) United States Patent
Yang et al.

(10) Patent No.: US 8,783,055 B2
(45) Date of Patent: Jul. 22, 2014

(54) REFRIGERATOR

(75) Inventors: Yun Ho Yang, Yongin-si (KR); Sang Woon Jeon, Namyangiu-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 210 days.

(21) Appl. No.: 13/137,563

(22) Filed: Aug. 25, 2011

(65) Prior Publication Data

US 2012/0060540 A1 Mar. 15, 2012

(30) Foreign Application Priority Data

Sep. 10, 2010 (KR) ..... 10-2010-0089018

(51) Int. Cl.
*F25D 3/02* (2006.01)

(52) U.S. Cl.
USPC ..... 62/318; 62/338; 62/377

(58) Field of Classification Search
USPC ..... 62/317–318, 337–339, 377
See application file for complete search history.

(56) References Cited

U.S. PATENT DOCUMENTS

| | | | | |
|---|---|---|---|---|
| 2,299,103 | A * | 10/1942 | Miller et al. | 222/160 |
| 7,188,486 | B2 * | 3/2007 | Olive et al. | 62/339 |
| 2005/0229623 | A1 * | 10/2005 | Kim | 62/389 |
| 2008/0156015 | A1 * | 7/2008 | Meyerholtz et al. | 62/318 |
| 2009/0038330 | A1 * | 2/2009 | Lee et al. | 62/344 |

FOREIGN PATENT DOCUMENTS

| | | |
|---|---|---|
| JP | 4056530 | 12/2007 |
| KR | 10-2006-0027445 | 3/2006 |
| KR | 10-2008-0094331 | 10/2008 |

* cited by examiner

*Primary Examiner* — Cassey D Bauer
(74) *Attorney, Agent, or Firm* — Staas & Halsey LLP

(57) ABSTRACT

A refrigerator in which a water tank and a filter, which have conventionally been located in a storage compartment, are installed to a rear surface of a door and are arranged in parallel to a dispenser, which expands a storage space of the storage compartment and shortens a water supply path between the water tank and the dispenser.

13 Claims, 6 Drawing Sheets

REFRIGERATOR

CROSS-REFERENCE TO RELATED APPLICATIONS

This application claims the benefit of Korean Patent Application No. 2010-0089018, filed on Sep. 10, 2010 in the Korean Intellectual Property Office, the disclosure of which is incorporated herein by reference.

BACKGROUND

1. Field

Embodiments of the present disclosure relate to a refrigerator, a door of which has an improved rear surface structure, which assures enhanced usability and provides a storage compartment with an enlarged storage space.

2. Description of the Related Art

A French Door Refrigerator (FDR) includes separate upper and lower storage compartments, the upper storage compartment serving as a refrigerating compartment and the lower storage compartment serving as a freezing compartment.

The refrigerating compartment is opened or closed by a pair of rotating opening/closing doors hinged to opposite sides of a main body. The freezing compartment is provided with a drawer type sliding door, which slides into or out of the freezing compartment.

The left and right rotating opening/closing doors are provided at rear surfaces thereof with door guards in which beverages or relatively small items of food are accommodated. Any one of the left and right rotating opening/closing doors is provided with a dispenser to allow a user to retrieve water or ice without opening the door.

Conventionally, the refrigerating compartment contains an icemaker to make ice, a filter to purify water fed from an external water source, and a water tank in which water is stored so as to be fed into the dispenser via user manipulation.

In the refrigerator having the above-described configuration, purified water having passed through the filter is temporarily stored in the water tank installed in a rear region of the refrigerating compartment and then, is fed to the dispenser toward the door. A water supply path from the filter to the dispenser or from the water tank to the dispenser is lengthy and therefore, the water present in a water supply hose may go bad or leave behind mineral deposits in the water supply hose if the dispenser does not discharge water for a long time, which is undesirable in view of sanitation.

In addition, the water tank and the filter are installed in the rear region of the refrigerating compartment, making it difficult for the user to replace or clean the water tank and the filter.

SUMMARY

Therefore, it is one aspect of the present disclosure to provide a refrigerator in which a water tank and a filter, which have conventionally been located in a storage compartment, are installed to a rear surface of a door, allowing a user to retrieve clean water from a dispenser and improving space utilization of a storage compartment.

It is another aspect of the present disclosure to provide a refrigerator in which a water tank and a filter are detachably coupled to a rear surface of a door which a user can easily access, allowing the user to easily replace and clean the water tank and the filter and to manually supply water into the water tank.

Additional aspects of the disclosure will be set forth in part in the description which follows and, in part, will be apparent from the description, or may be learned by practice of the disclosure.

In accordance with one aspect of the present disclosure, a refrigerator includes a storage compartment, at least one rotating door to open or close the storage compartment, an icemaker provided in the storage compartment, a dispenser having an ice withdrawal space, from which a user takes ice, and a water discharge hole, from which the user takes water, a filter to purify water supplied from an external water source, a water tank to store the water purified in the filter, and a valve provided at a junction of a hose where the filter is connected to the water tank and the icemaker so as to selectively supply the water purified in the filter to the water tank or the icemaker, wherein the water tank is provided at a rear surface of the door and is arranged in parallel to the dispenser such that lateral surfaces of the water tank and the dispenser are close to each other, and wherein the filter is accommodated between the dispenser and the water tank.

The icemaker may include an ice discharge hole through which ice is discharged to the dispenser, the dispenser may include a chute to guide the ice from the ice discharge hole to the ice withdrawal space, and the chute of the dispenser may be located close to the ice discharge hole when the door is closed.

The dispenser and the water tank may be provided respectively with filter receptacles, and the filter receptacles may be indented to correspond to the shape of the filter for accommodation of the filter.

The valve may be located in the dispenser.

The water tank may be detachably mounted to the rear surface of the door.

The water tank may be provided with a hook type elastic lever for detachable mounting of the water tank and the door may be provided with a holder portion which is caught and kept stationary by the elastic lever.

The water tank may be provided at the top thereof with an entrance to allow a user to directly manually supply water into the water tank.

The filter may be detachably mounted between the dispenser and the water tank.

The water tank may be made of a transparent material.

In accordance with another aspect of the present disclosure, a refrigerator includes a storage compartment, an icemaker provided in the storage compartment, and at least one door hingedly coupled to a lateral surface of a main body so as to open or close the storage compartment, wherein the door includes a dispenser, a filter to purify water supplied from an external water source, a water tank to store the water purified in the filter, and a valve provided at a junction of a hose where the filter is connected to the water tank and the icemaker so as to selectively supply the water purified in the filter to the water tank or the icemaker, wherein the dispenser and the water tank are arranged in parallel to each other, and wherein the dispenser and the water tank are provided respectively with filter receptacles and the filter receptacles are indented to correspond to the shape of the filter for accommodation of the filter.

The water tank may be detachably mounted to the door.

The water tank may be provided at the top thereof with an entrance to allow a user to directly manually supply water into the water tank.

The filter may be detachably mounted between the dispenser and the water tank.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
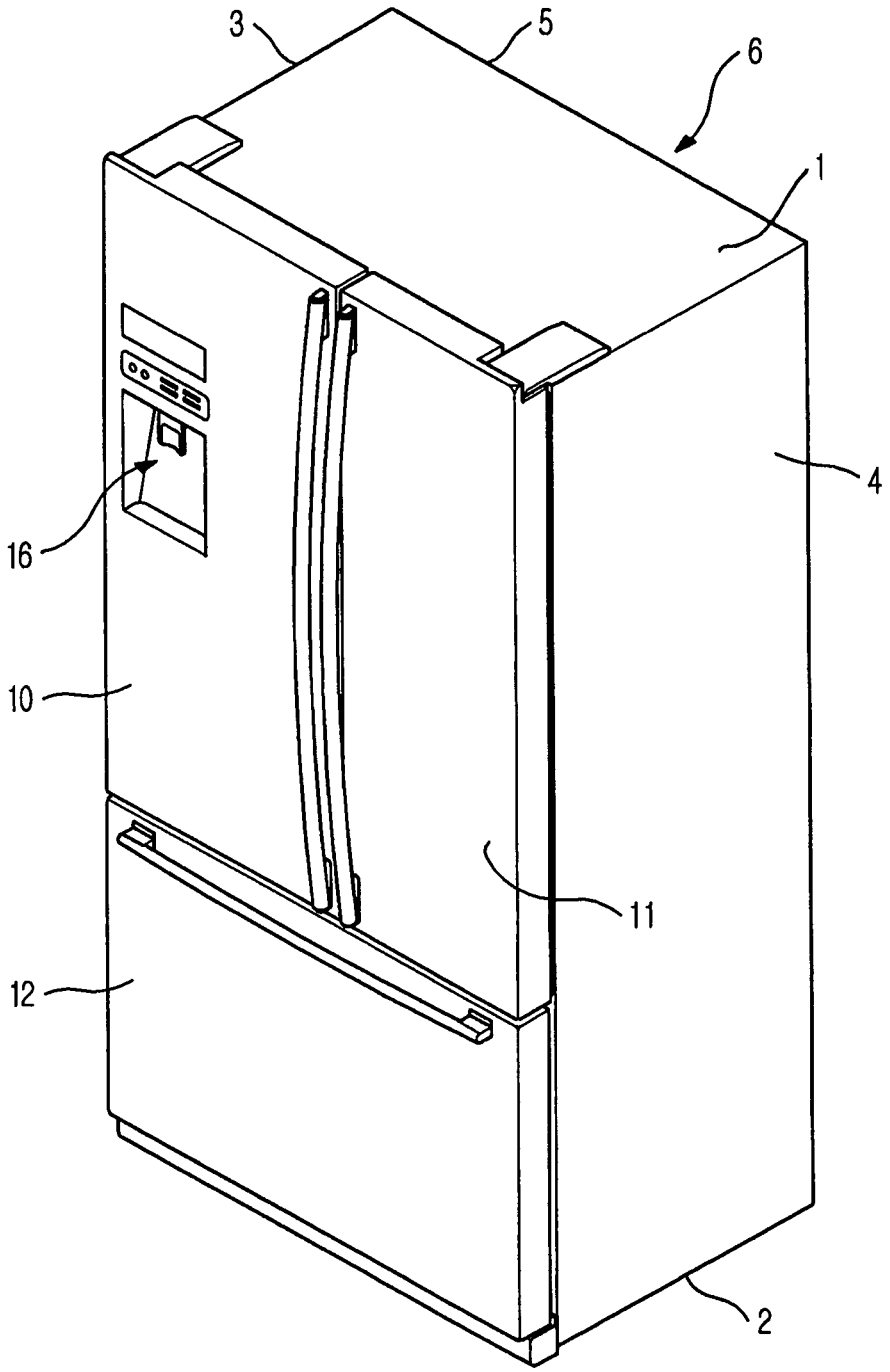
FIG. 1 is a perspective view illustrating a refrigerator according to an embodiment.

Reference will now be made in detail to the embodiments of the present disclosure, examples of which are illustrated in the accompanying drawings, wherein like reference numerals refer to like elements throughout.

Figure 2:
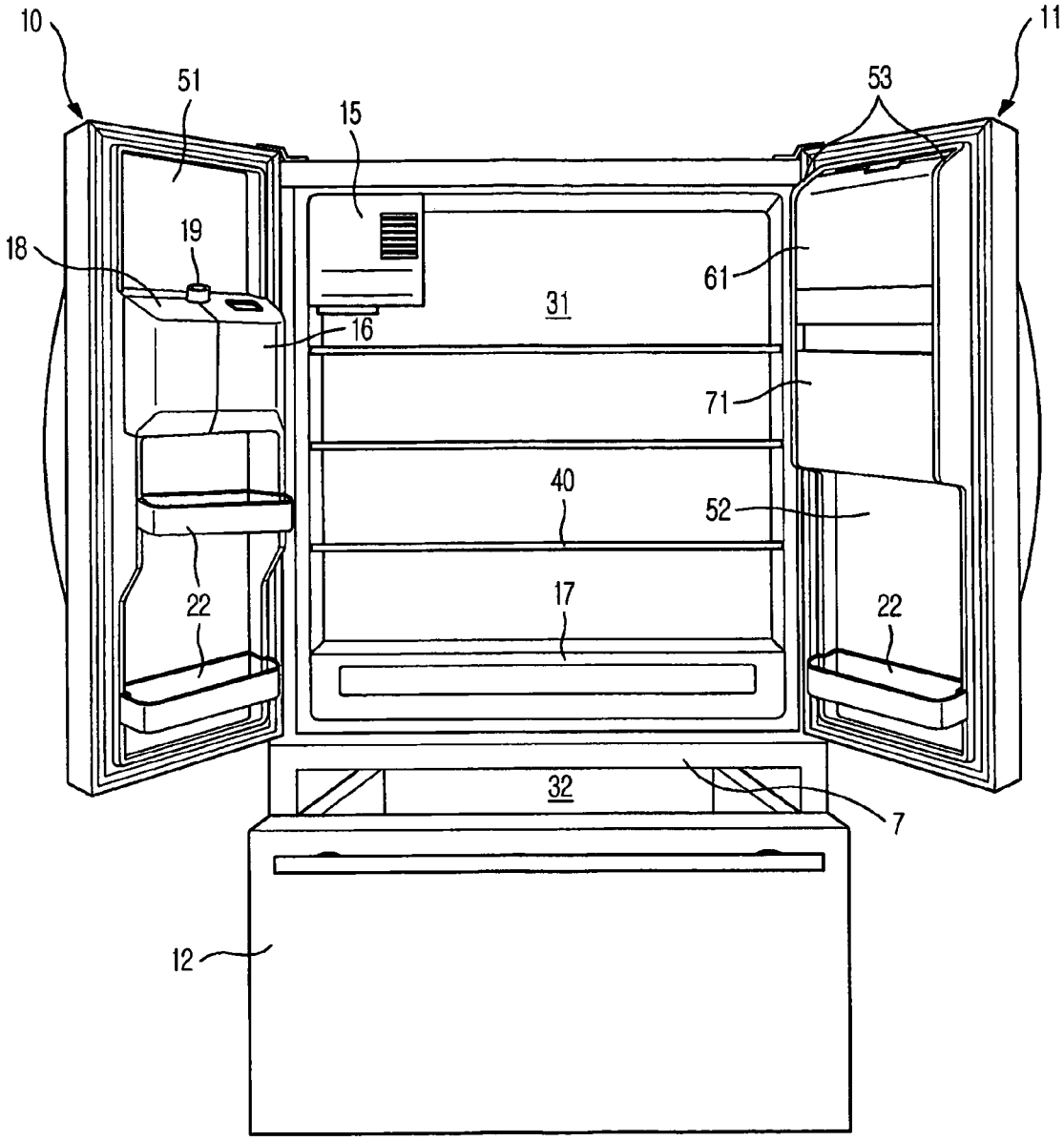
FIG. 2 is a front view illustrating an open state of doors of the refrigerator according to an embodiment.
Figure 3:
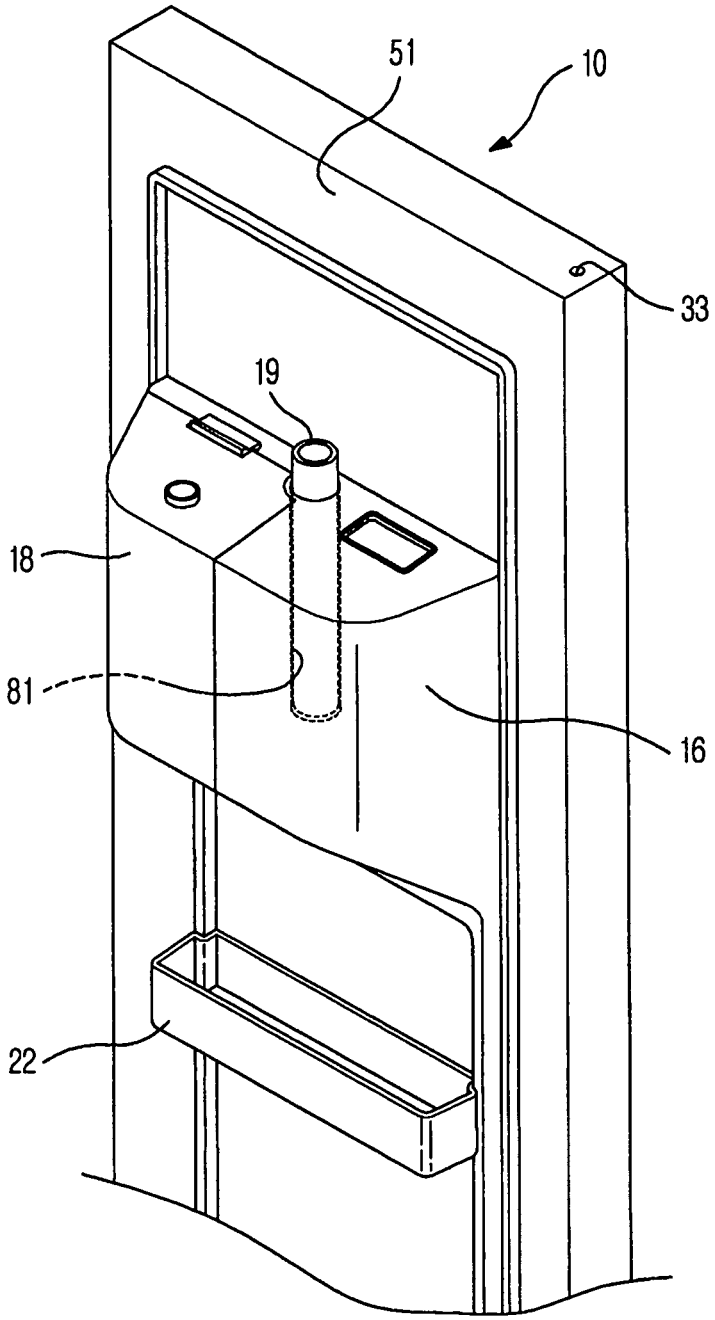
FIG. 3 is a view illustrating a water tank and a filter installed to a rear surface of the door according to an embodiment.

FIG. 1 is a perspective view illustrating a refrigerator according to an embodiment, FIG. 2 is a front view illustrating an open state of doors of the refrigerator according to an embodiment, and FIG. 3 is a view illustrating a water tank and a filter installed to a rear surface of the door according to an embodiment.

Referring to FIGS. 1 to 3, the refrigerator according to the embodiment is a French Door Refrigerator (FDR) and includes a top panel 1, a bottom panel 2, lateral panels 3 and 4, and a rear panel 5. Storage compartments 31 and 32 defined in a main body 6 are divided into an upper refrigerating compartment 31 and a lower freezing compartment 32 by a horizontal partition 7.

The refrigerating compartment 31 has an open front side and is opened or closed by left and right rotating opening/closing doors 10 and 11. The left and right rotating opening/closing doors 10 and 11 are coupled to opposite sides of the main body 6 via hinge members 33 so as to be pivotally rotatable forwardly.

The right rotating opening/closing door 11 is provided with a pair of protruding portions 53. The protruding portions 53 protrude from a rear surface 52 of the door 11 to define vegetable chambers 61 and 71 therebetween. The vegetable chambers 61 and 71 provide a storage space for food, such as vegetables, fruit, etc., which has relatively small volume and needs to be kept separate from other food to preserve taste and smell. To sort and accommodate various vegetables on a per kind basis, a first vegetable chamber 61 and a second vegetable chamber 71 are separated from each other.

The left rotating opening/closing door 10 is provided with a dispenser 16 to allow a user to retrieve beverages or ice without opening the doors 10 and 11. The dispenser 16 includes an ice withdrawal space 26 through which the user can retrieve ice from the outside and a water discharge hole 25 through which the user can retrieve water from the outside. The dispenser 16 protrudes inward from a rear surface 51 of the door 10 by a predetermined distance.

It will be appreciated that the dispenser 16 and a water tank 18, filter 19 and valve 20, which will be described hereinafter, may be provided at the right door 11. Also, although the present embodiment describes the refrigerator as having the two left and right rotating opening/closing doors 10 and 11, the concept of the present embodiment may also be applied to a refrigerator having a single rotating opening/closing door.

The rear surfaces 51 and 52 of the doors 10 and 11 are provided with door guards 22 to accommodate relatively small items of food.

The freezing compartment 32 is provided with a drawer type sliding door 12 to be pushed into or pulled out of the freezing compartment 32.

An icemaker 15 to make ice is installed in an upper corner region of the refrigerating compartment 31. A pantry 17 is provided in a lower region of the refrigerating compartment 31 and has a width equal to that of the refrigerating compartment 31 so as to store relatively wide storage items.

The refrigerating compartment 31 contains a shelf 40 on which food is placed.

The water tank 18 is installed to the rear surface 51 of the door 10 to supply water into the dispenser 16.

In particular, the water tank 18 is installed in parallel to the dispenser 16 of the door 10 at a position close to the dispenser 16. Minimizing a distance between the water tank 18 and the dispenser 16 assures improved sanitation of water because water does not pass through a long complicated water supply pipe.

Further, eliminating a need to separately install the water tank 18 in the refrigerating compartment 31 may provide the refrigerating compartment 31 with an expanded storage space.

The water tank 18 is made of a transparent material to allow the user to view water stored in the water tank 18. Since the water tank 18 is located at the rear surface 51 of the door 10 where the user can easily view the water tank 18 and the water tank 18 is made of a transparent material, the user can directly check the amount of water stored in the water tank 18 or the sanitary condition of water.

The water tank 18 is provided at the top thereof with an entrance 21 to allow the user to manually inject water into the water tank 18. In addition, the water tank 18 is detachably installed to the door 10 to allow the user to separate the water tank 18 from the door 10 to supplement water, or clean or replace the water tank 18.

Figure 4:
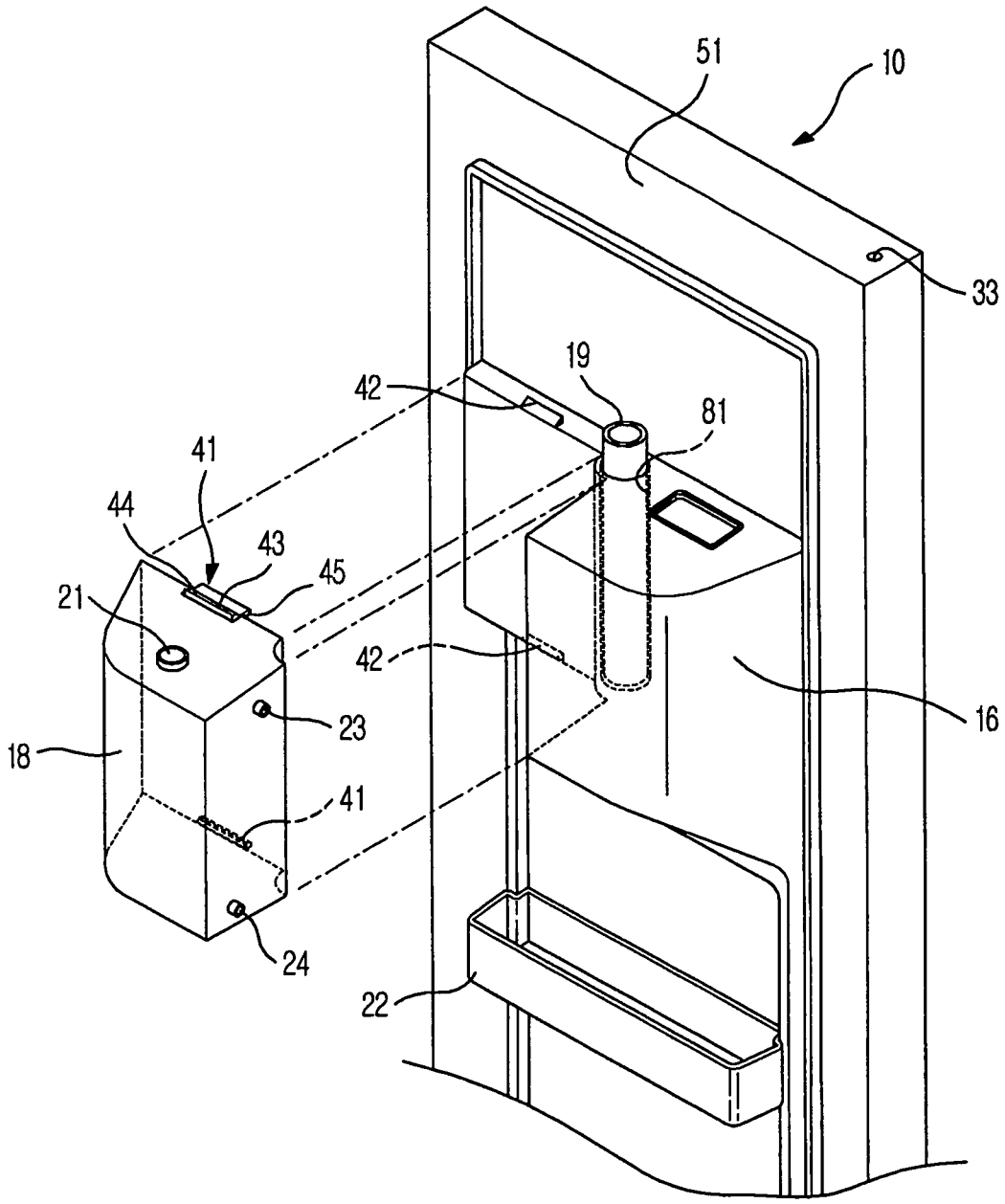
FIG. 4 is a view illustrating a coupling relationship between the water tank and the door of the refrigerator.

FIG. 4 is a view illustrating a coupling relationship between the water tank and the door of the refrigerator.

Referring to FIG. 4, to detachably mount the water tank 18 to the rear surface 51 of the first door 10, the water tank 18 is provided with a hook type elastic lever 41, and the first door 10 is provided at a position corresponding to the elastic lever 41 of the water tank 18 with a holder portion 42 which is caught and kept stationary by the elastic lever 41.

The elastic lever 41 is installed so as to be rotated about a rotating shaft 43. To this end, the elastic lever 41 includes a push portion 44 provided at one end of the rotating shaft 43, the push portion 44 being a portion which the user will push, a hook portion 45 provided at the other end of the rotating shaft 43, and an elastic member (not shown) provided inside the push portion 44 so as to press the push portion 44 outward.

With the above-described configuration, the water tank 18 is detachable from the first door 10 as the hook portion 45 of the elastic lever 41 is caught by or released from the holder portion 42 of the first door 10.

As such, the user can manually separate the water tank 18 from the first door 10 when it is desired to inject water into the entrance 21 formed at the top of the water tank 18.

Although a water supply system will be described hereinafter, in this case, the valve 20 is automatically controlled to intercept water flowing to the water tank 18 and supply water only to the icemaker 15, thereby preventing leakage of water.

A filter receptacle 81 is provided between the dispenser 16 and the water tank 18 to accommodate the filter 19 which purifies water supplied to the dispenser 16.

Specifically, the filter receptacle 81 is defined by indented portions of the dispenser 16 and the water tank 18 and has a shape corresponding to the filter 19 such that the filter 19 is inserted between the dispenser 16 and the water tank 18. The filter 19 is detachably inserted into the filter receptacle 81.

The filter 19 may include a head (not shown) connected to an external water source 13 and the valve 20, and a filter body (not shown) separable from the head (not shown), the filter body containing a filter member. When the filter body (not shown) is separated from the head (not shown), water supplied from the external water source 13 is bypassed from the head (not shown) to the valve 20 so as to prevent leakage of water. The configuration of the filter 19 is known and thus, a detailed description thereof will be omitted herein.

Figure 5:
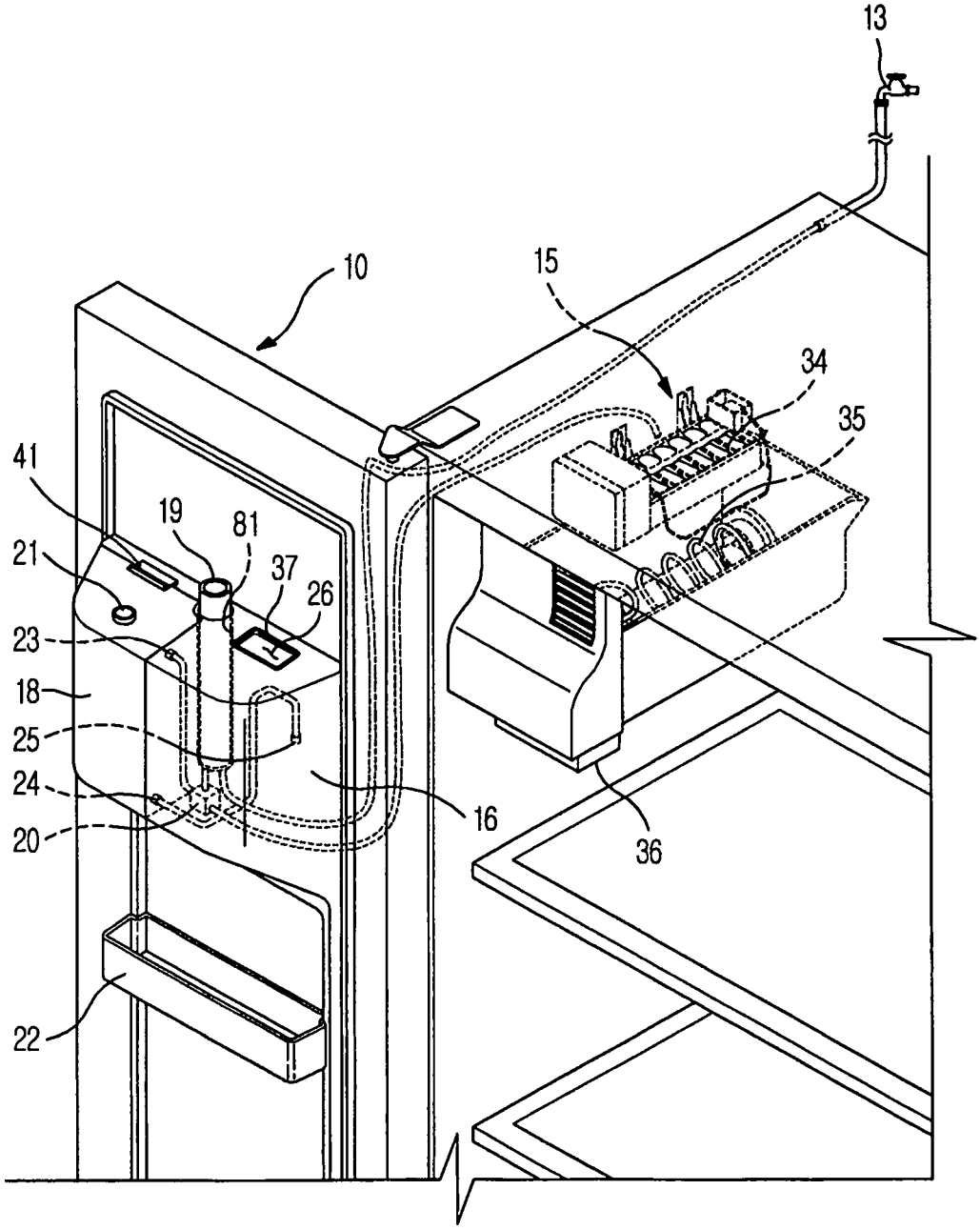
FIG. 5 is a view schematically illustrating a water supply system of the refrigerator according to an embodiment.
Figure 6:
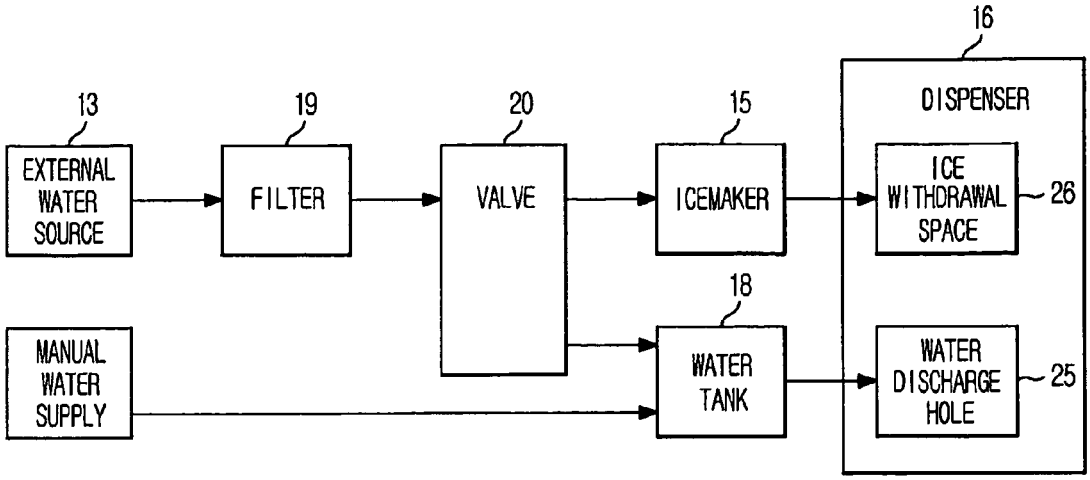
FIG. 6 is a block diagram of the water supply system.

FIG. 5 is a view schematically illustrating a water supply system of the refrigerator according to an embodiment, and FIG. 6 is a block diagram of the water supply system.

Although the refrigerator may employ various kinds of water supply systems, as illustrated in FIGS. 5 and 6, the water supply system may include the valve 20 to supply water from the external water source 13 into the water tank 18 through a water supply pipe under control. Specifically, the water supply system may include the filter 19 to purify water supplied from the external water source 13, the water tank 18 to store the water purified in the filter 19, and the valve 20 provided at a junction of a hose where the filter 19 is connected to the water tank 18 and the icemaker 15 so as to selectively supply the water purified in the filter 19 into the water tank 18 or the icemaker 15.

In this case, the valve 20 is accommodated in the dispenser 16.

The water purified in the filter 19 is moved to the water tank 18 or the icemaker 15 under control of the valve 20.

The water moved to the water tank 18 is introduced into the water tank 18 through the entrance 23 of the water tank 18. After the water stored in the water tank 18 is cooled to a temperature suitable for drinking, the water is moved to the water discharge hole 25 of the dispenser 16 through an exit 24 of the water tank 18, enabling the user to drink the water.

The icemaker 15 includes an ice-making tray 34 in which ice is made, and an ice transfer device 35 to move the ice to an ice discharge hole 36. After the water moved to the icemaker 15 is frozen into ice in the ice-making tray 34 of the icemaker 15, the ice is moved to the ice discharge hole 36 by the ice transfer device 35.

The dispenser 16 includes a chute 37 provided at a position corresponding to the ice discharge hole 36 of the icemaker 15 to guide the ice discharged from the ice discharge hole 36 to the ice withdrawal space 26 provided at the outside of the door 10. When the door 10 is closed, an entrance of the chute 37 is aligned with the ice discharge hole 36 of the icemaker 15.

In the ice withdrawal space 26 provided at the outside of the door 10, the user may retrieve the ice made by the icemaker 15 provided in the refrigerating compartment 31.

Although not illustrated, a valve may be provided at a junction of a hose where the water tank 18 is connected to the icemaker 15 and the dispenser 16 so as to selectively supply water stored in the water tank 18 to the icemaker 15 or the dispenser 16. In this case, as the water, which has been cooled to an appropriate temperature in the water tank 18, is supplied to the icemaker 15, energy required for ice making may be reduced.

As is apparent from the above description, one or more embodiments of the present disclosure may include a refrigerator in which a water tank and a filter usable with a dispenser are installed to a rear surface of a door, having a simplified pipe structure connecting the dispenser and the water tank to each other and guaranteeing reliable sanitation of water discharged from the dispenser. As compared to a conventional refrigerator in which a water tank and a filter are arranged in a storage compartment, the refrigerator according to the embodiments results in an expanded storage space.

Further, as the water tank and the filter are detachably mounted to the rear surface of the door, the user can easily access the water tank and the filter in order to clean or replace them or to directly supply water into the water tank.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a storage compartment;

at least one rotating door to open or close the storage compartment;

an icemaker provided in the storage compartment;

a dispenser having an ice withdrawal space, from which a user takes ice, and a water discharge hole, from which the user takes water;

a filter to purify water supplied from an external water source;

a water tank to store the water purified in the filter; and a valve provided at a junction of a hose where the filter is connected to the water tank and the icemaker so as to selectively supply the water purified in the filter to the water tank or the icemaker, wherein the water tank is provided at a rear surface of the door and is arranged in parallel to the dispenser such that lateral surfaces of the water tank and the dispenser are close to each other, and wherein the filter is accommodated between the dispenser and the water tank, wherein the dispenser and the water tank are provided respectively with filter receptacles, and the filter receptacles are indented to correspond to the shape of the filter for accommodation of the filter.

2. The refrigerator according to claim 1, wherein:

the icemaker includes an ice discharge hole through which ice is discharged to the dispenser;

the dispenser includes a chute to guide the ice from the ice discharge hole to the ice withdrawal space; and the chute of the dispenser is located close to the ice discharge hole when the door is closed.

3. The refrigerator according to claim 1, wherein the valve is located in the dispenser.

4. The refrigerator according to claim 1, wherein the water tank is detachably mounted to the rear surface of the door.

5. The refrigerator according to claim 4, wherein the water tank is provided with a hook type elastic lever for detachable mounting of the water tank and the door is provided with a holder portion which is caught and kept stationary by the elastic lever.

6. The refrigerator according to claim 1, wherein the water tank is provided at the top thereof with an entrance to allow a user to directly manually supply water into the water tank.

7. The refrigerator according to claim 1, wherein the filter is detachably mounted between the dispenser and the water tank.

8. The refrigerator according to claim 1, wherein the water tank is made of a transparent material.

9. The refrigerator according to claim 1, further comprising a valve provided at a junction of a hose where the water tank is connected to the icemaker and the dispenser so as to selectively supply water stored in the water tank to the icemaker or the dispenser to supply cooled water to the icemaker thereby reducing energy required for ice making.

10. A refrigerator comprising a storage compartment, an icemaker provided in the storage compartment, and at least one door hingedly coupled to a lateral surface of a main body so as to open or close the storage compartment, wherein the door includes a dispenser, a filter to purify water supplied from an external water source, a water tank to store the water purified in the filter, and a valve provided at a junction of a hose where the filter is connected to the water tank and the icemaker so as to selectively supply the water purified in the filter to the water tank or the icemaker, wherein the dispenser and the water tank are arranged in parallel to each other, and wherein the dispenser and the water tank are provided respectively with filter receptacles and the filter receptacles are indented to correspond to the shape of the filter for accommodation of the filter.

11. The refrigerator according to claim 10, wherein the water tank is detachably mounted to the door.

12. The refrigerator according to claim 10, wherein the water tank is provided at the top thereof with an entrance to allow a user to directly manually supply water into the water tank.

13. The refrigerator according to claim 10, wherein the filter is detachably mounted between the dispenser and the water tank.

* * * * *

UNITED STATES PATENT AND TRADEMARK OFFICE

CERTIFICATE OF CORRECTION

PATENT NO. : 8,783,055 B2
APPLICATION NO. : 13/137563
DATED : July 22, 2014
INVENTOR(S) : Yun Ho Yang et al.

It is certified that error appears in the above-identified patent and that said Letters Patent is hereby corrected as shown below:

On the Title Page

Item [75] (Inventors), Line 2, Delete "Namyangiu-si" and insert -- Namyangju-si --, therefor.

Signed and Sealed this
Fourth Day of November, 2014

Michelle K. Lee

Michelle K. Lee
*Deputy Director of the United States Patent and Trademark Office*